US006817595B1

(12) United States Patent
Jenkins et al.

(10) Patent No.: US 6,817,595 B1
(45) Date of Patent: Nov. 16, 2004

(54) SWING ARM CHAIN SUPPORT METHOD

(75) Inventors: Vernon R. Jenkins, Humble, TX (US); Roy H. Cottrell, Cypress, TX (US)

(73) Assignee: FMC Technologies, Inc., Chicago, IL (US)

( * ) Notice: Subject to any disclaimer, the term of this patent is extended or adjusted under 35 U.S.C. 154(b) by 15 days.

(21) Appl. No.: 10/359,518

(22) Filed: Feb. 5, 2003

Related U.S. Application Data

(60) Provisional application No. 60/354,600, filed on Feb. 5, 2002.

(51) Int. Cl.[7] ..... B66D 3/04

(52) U.S. Cl. ..... 254/389; 114/200; 114/293

(58) Field of Search ..... 254/389, 390, 254/391, 415; 114/200, 293; 188/65.1

(56) References Cited

U.S. PATENT DOCUMENTS 1,673,297 A * 6/1928 Moreno ..... 254/343
3,810,359 A * 5/1974 Schreyer et al. ..... 59/93
3,842,776 A * 10/1974 Wudtke ..... 114/294
4,497,471 A * 2/1985 Longberg et al. ..... 254/372
4,513,681 A * 4/1985 Crook, Jr. ..... 114/293
4,724,789 A * 2/1988 van den Haak ..... 114/293
4,958,805 A * 9/1990 Willamsson ..... 254/332
5,730,425 A * 3/1998 Brooks ..... 254/266
5,845,893 A 12/1998 Groves ..... 254/389
6,431,101 B1 * 8/2002 Lunde et al. ..... 114/179

* cited by examiner

*Primary Examiner*—Emmanuel Marcelo
(74) *Attorney, Agent, or Firm*—Gary L. Bush; Andrews Kurth LLP

(57) ABSTRACT

A swing arm type chain support with a hook arrangement integral with a swing arm which allows a mooring chain to ratchet over the hook while tensioning, then automatically engage the hook when tension is reduced.

9 Claims, 4 Drawing Sheets

FIG.1
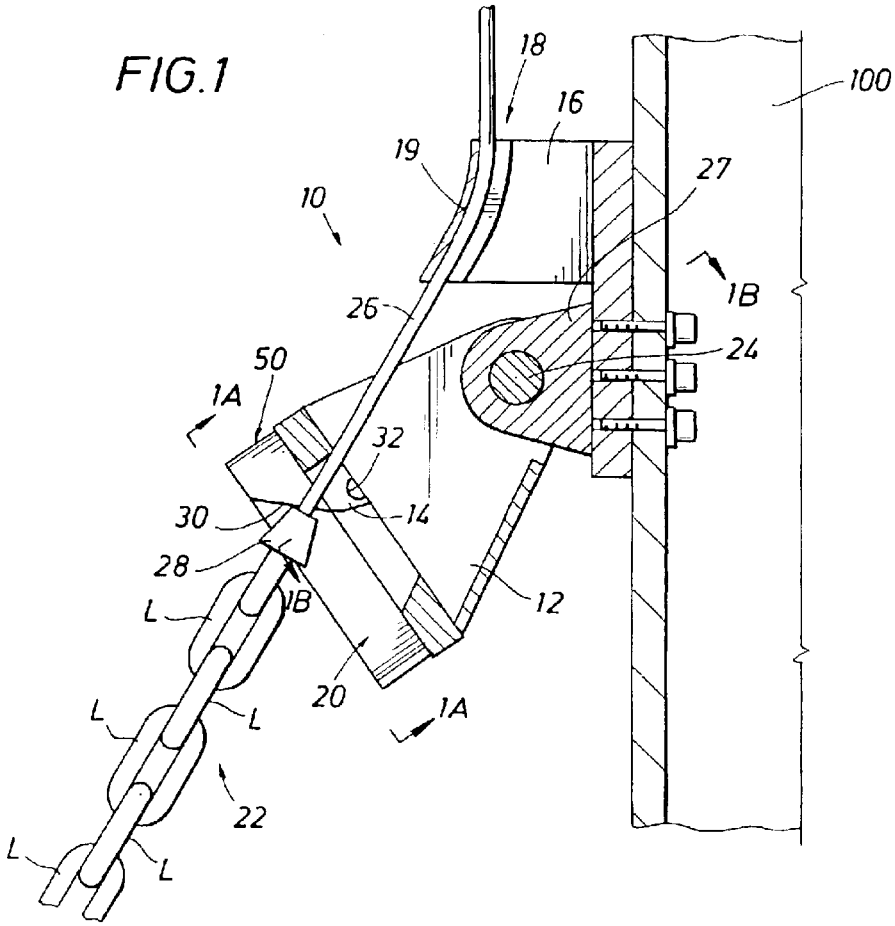
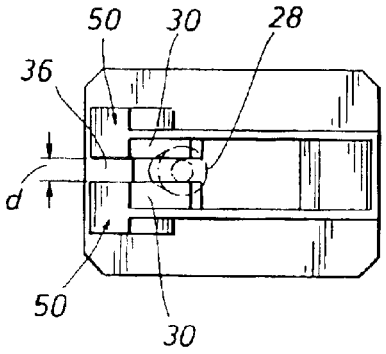
FIG.1A
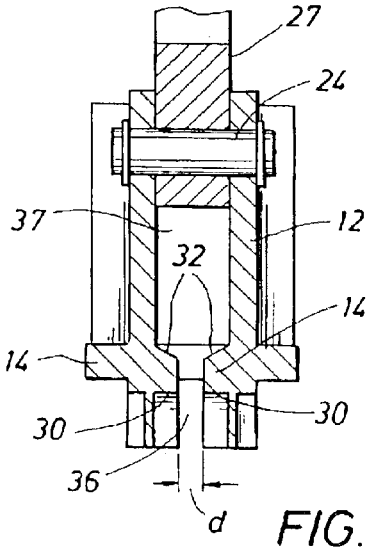
FIG.1B

SWING ARM CHAIN SUPPORT METHOD

CROSS REFERENCE TO RELATED APPLICATION

This application is based upon provisional application 60/354,600 filed on Feb. 5, 2002, the priority of which is claimed.

BACKGROUND OF THE INVENTION

1. Field of the Invention

This invention relates generally to mooring systems for offshore structures such as platforms and vessels and in particular, to a device which supports the mooring chain in such systems.

2. Description of the Prior Art

Offshore structures such as platforms (e.g. tension leg and SPAR platforms) and vessels (e.g., floating storage and offloading vessels; floating production storage and offloading vessels; and floating storage drilling production and drilling units) at times, require a moored (or anchored) connection to the sea floor. Such moored connections enable the offshore structure to remain in a relatively stable position resisting forces caused by environmental conditions such as wind, waves, and the like. To establish the moored connection, an anchor is embedded into the seafloor, and a mooring chain or the like is attached thereto. The moored chain is then attached to a guideline from the offshore structure and "reeled" in until a desired tension is created on the chain between the buoyant uplift of the offshore structure and downward pulling force of the anchor. To facilitate this reeling, a plurality of different chain guides and devices are known in the art. To maintain the tensile connection, a chain stopper or device is needed.

U.S. Pat. No. 5,845,893, issued to Groves discloses two devices for maintaining tension. The first, "a latch mechanism," includes a latch housing and bending shoe, which are gimbaled to the offshore structure. The chain is passed through the latch housing; and then, when a desired tension is reached, a latch engages the chain via a manual intervention or a remotely operated hydraulic device. The second, "a pelican hook," works in a similar manner, but engages the chain via a book using a hydraulically actuated arm.

IDENTIFICATION OF OBJECTS OF THE INVENTION

A primary object of the invention is to provide a simple and inexpensive chain support that requires no powered actuator for latching the chain.

Another object of the invention is to provide a chain support with minimal moving parts.

Another object of the invention is to provide a chain support that provides a latching mechanism with no moving parts.

Another object of the invention is to provide a chain support assembly that has only one moving part, no manually manipulated chain stopper, using readily available materials at a cost lower than designs currently used.

SUMMARY OF THE INVENTION

The objects identified above along with other advantages and features are incorporated in a chain support that latches a mooring chain without an actuator required The swing arm with a hook fixed thereto, is mounted so that it can pivot about a horizontal axis with respect to the offshore structure. The swing arm has a mouth in which two plates are mounted parallel to each other to form a passage between each other that is separated by a distance large enough to allow a guideline to pass, but small enough to prevent a guide device or a perpendicularly oriented chain link from passing through. Chain links which are oriented parallel to the passage pass through the passage while the chain is being pulled up through the swing arm. Chain links oriented perpendicularly to the passage are too wide to pass through the passage. The plates include sloping guide ramps which are arranged so that when a perpendicular oriented chain link passes through the mouth and meets the ramps through upward pulling tension, the force of the perpendicular chain link causes the swing arm to pivot upwardly. The swing arm pivots upwardly and downwardly for ratcheting of the chain links when they are pulled altematingly through the passage between the plates and over the ramps of the plates. When tension is relaxed on the chain, the swing arm rotates downwardly and a link is captured by the hooks of the plates.

BRIEF DESCRIPTION OF THE DRAWINGS

FIG. 1 shows a side section view of a chain support/latch mechanism which shows a chain support and a swing arm/hook arrangement according to the invention at a time prior to the chain entering the swing arm;

FIG. 1A is a section view taken along lines A—A of FIG. 1 and which shows the mouth of the swing arm with plates and hooks mounted thereto, and with a guide device of a guideline entering the mouth;

FIG. 1B is a section view taken along lines B—B of FIG. 1;

DESCRIPTION OF THE PREFERRED EMBODIMENTS

Figure 2:
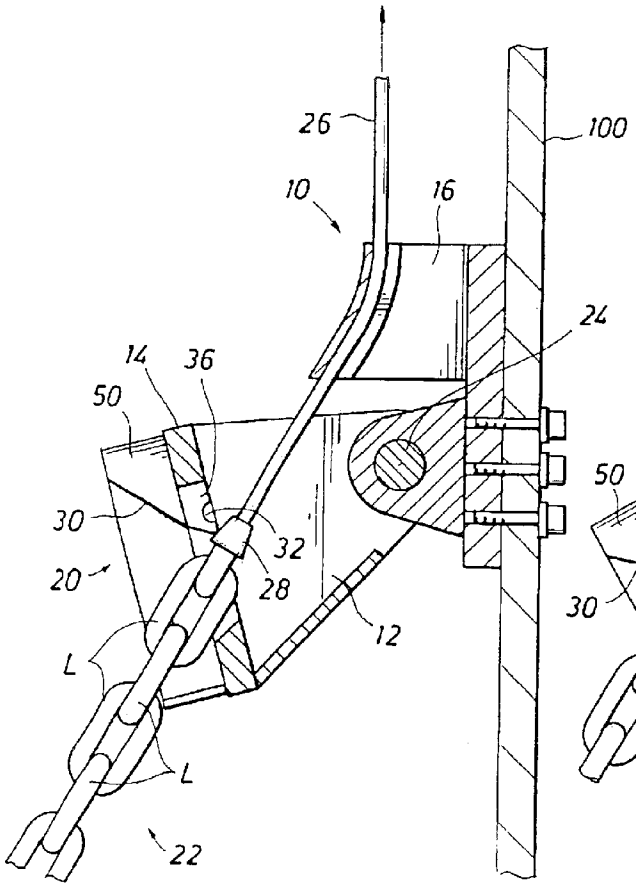
FIG. 2 shows a side view of the chain at a position in the chain support where the guide device of the chain has contacted the guide ramps while being pulled upwardly by a guideline and as a result the swing arm has been rotated such that the guide device is at the tip of the hook.

FIGS. 1–4 show section side views of a chain support 10 of a first embodiment of the invention where swing arm 12 and chain guide 16 are separate devices. The chain guide 16 is mounted to offshore structure 100 above chain support 16 and includes grooves 18 designed and arranged to orient links L such that alternating links are parallel (in line) or perpendicular to a surface 19 in chain guide 16. The chain support 10 swing are 12 includes hooks 14 integral with plates 50 which are fixed in the mouth 20 as shown in FIGS. 1, 1A, and 2–4. The plates 50 define a hook passage 36 which is characterized by a distance d which is large enough to pass the guideline 26 and a link L of chain 22 that is in line or parallel with passage 36. The hook passage 36 communicates with interior passage 37. The distance d is too small for a guide device 28 or a perpendicular link L of chain 22 to pass through it, so as the guideline 26 is pulled upwardly via interior passage 37, a guide device 28 (or a perpendicular link L) meets ramps 30 of plates 50 and causes swing arm 12 to pivot upwardly about pin 24 as shown in FIG. 2.

As shown in FIGS. 1–4 and 1B, the swing arm 12 is mounted for rotation with respect to a bracket 27 by means of pivot pin 24 through swing arm 12 and bracket 27. The bracket 27 is mountable on offshore structure 100. A high strength homogenous composite bushing is provided between the pin 24 and the bracket 27 and the swing arm 12. The high strength of the bushing material reduces the required bearing area and diameter. The low elastic modulus of a composite bearing improves load distribution, particularly when the chain is pulled off center. Since the bushing is homogenous, the low friction properties exist throughout the entire thickness of the bushing, thereby allowing for greater wear.

The hooks 14 are formed into the top of guide ramps 30 of plates 50 and each includes a groove 32 which faces away from mouth opening 20. The hooks are placed on the swing arm 12 well below the pivot axis (that is, pin 24) of the swing arm 12, requiring very little side load on the chain 22 to cause the swing arm 12 of chain support 10 to rotate about the pin 24, thereby reducing chain wear.

Figure 4:
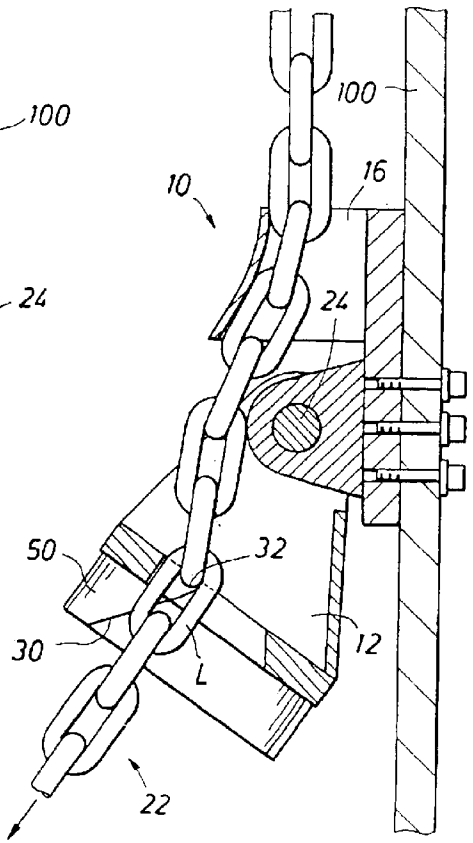
FIG. 4 shows a side section view of the hooks engaging and supporting the chain after tension on the guideline has been released.
Figure 3:
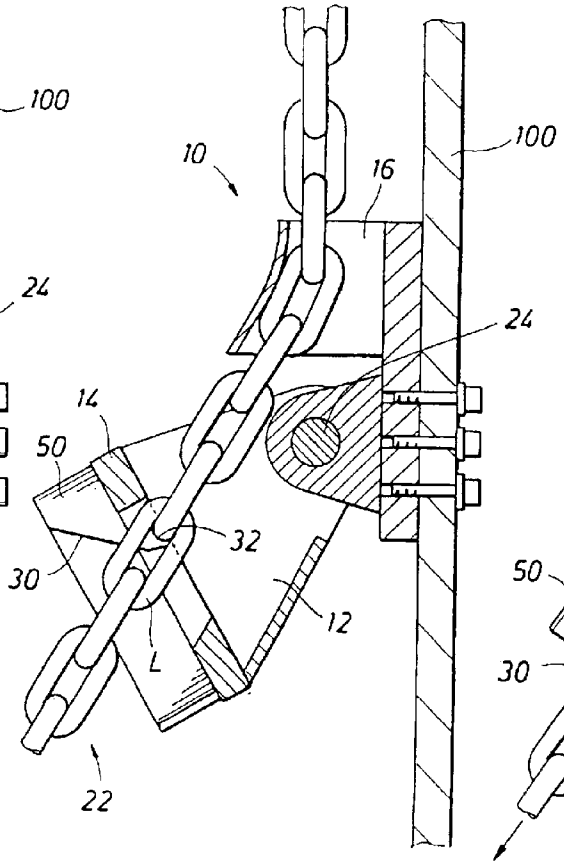
FIG. 3 shows a side section view of the chain being pulled through the chain support while ratcheting over the hooks.

FIGS. 1–4 also illustrate the operation of the chain support 10 while pulling in and securing an anchor chain to an offshore structure. The chain guide 16 and swing arm 12 are mounted as depicted in FIG. 1, and a guideline 26 is connected to a reeling mechanism (not shown) on the offshore structure 100. The guideline 26 is fed through interior passage 37 of the swing arm 12 and between plates 50 via hook passage 36 and connected to the end of the chain 22 by a guide device 28. The guideline 18 is pulled upwardly through chain guide 16 until the guide device 28 contacts ramps 30 of plates 50 causing swing arm 12 to rotate upward as illustrated in FIG. 2. The tension on chain 22 by guideline 26 holds the swing arm 12 up and prevents hooks 14 of plates 50 from fully engaging link L. In other words, the chain ratchets over the hooks 14 as illustrated in FIG. 2. During such ratcheting, chain links L can potentially rest on the hook 14 (if the reel on the guideline or top of the chain stops pulling) such that the hook 14 is inserted into a link L, thereby preventing the chain from moving downwardly. FIG. 3 shows hook 14 inserted in the interior of a link L with the link L resting on groove 32 of hook 14. As long as the chain 22 is pulled upwardly, parallel links L pass through hook passage 36, perpendicular links ride up and over ramp 30 and the links L continue to ratchet over hook 14. When the desired level of tension is achieved, tension is relaxed on the guideline 26, the hook 14 holds chain 22 as shown in FIG. 4, and the swing arm 12 rotates downwardly. The chain 22 is now latched to hooks 14 and secured to the offshore structure 100 by connection of swing arm 12 to the offshore structure 100. The longitudinal axis of the chain 22 is in line with pin 24.

Release of the chain support 10 is accomplished by tensioning the chain 22 until the swing arm 12 pivots to the position of FIG. 3. Manual release is accomplished by pivoting the swing arm upwardly to prevent chain engagement of hooks 14 as the chain is lowered. An eyelet (not shown) on the frame can be supplied for connecting a winch line or the like.

Figure 5:
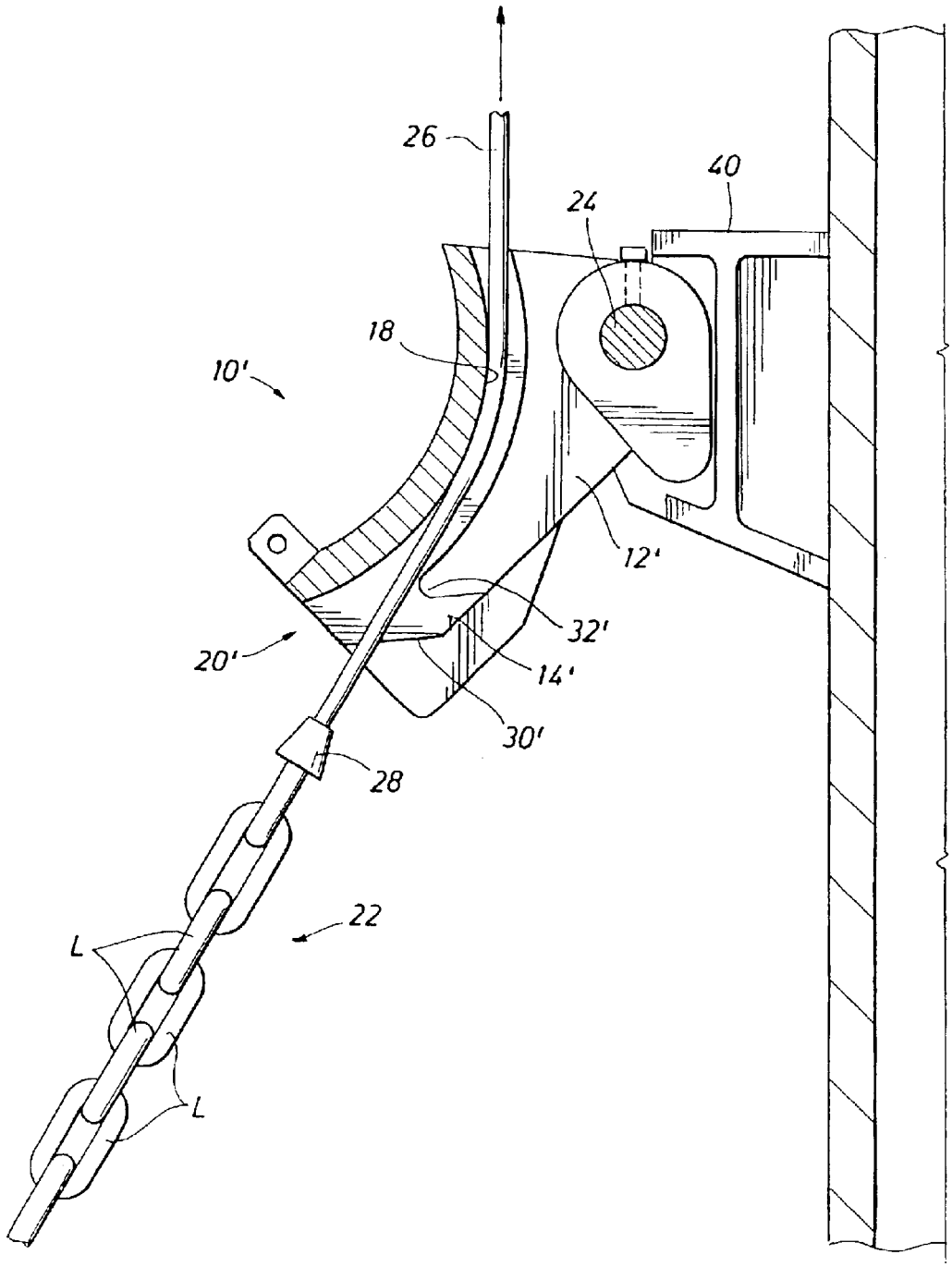
FIG. 5 shows a side view of an alternative arrangement according to the invention where the chain support includes an integral chain guide with the swing arm.
Figure 7:
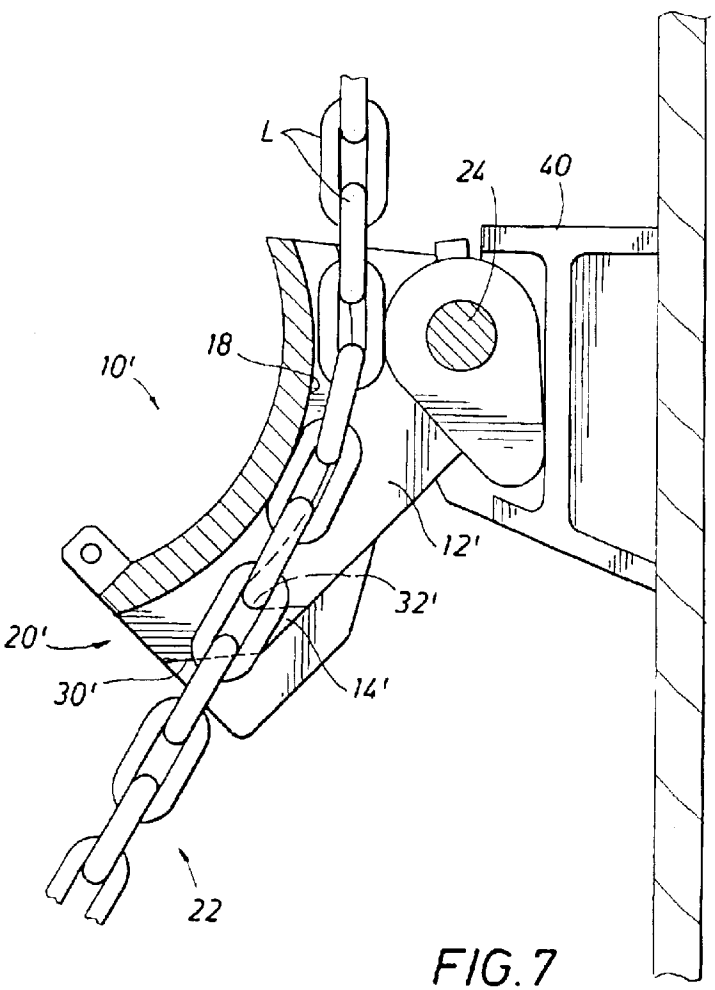
FIG. 7 shows a section side view of the alternative arrangement showing a parallel link being pulled through a passage between the two plates.
Figure 6:
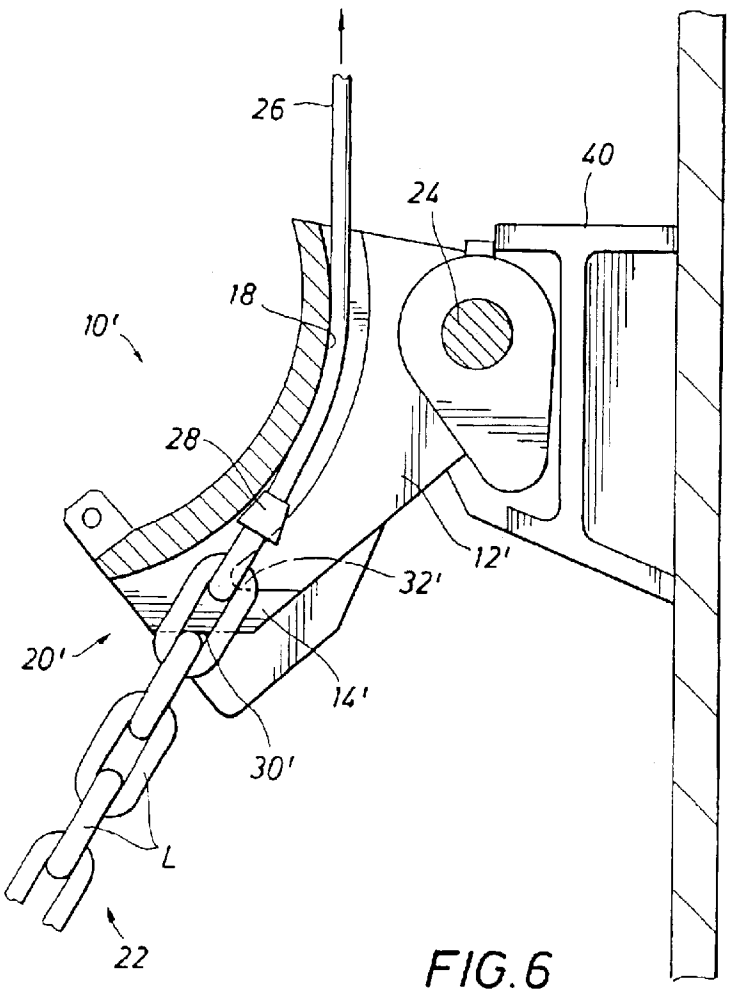
FIG. 6 shows a section side view of the alternative arrangement showing a perpendicular link of a chain being pulled over ramps of parallel ramp/hook plates.

An alternative embodiment of a swing arm chain support 10' is illustrated in FIGS. 5–7. The chain guide 16 of FIGS. 1–4 is incorporated within swing arm 12' of the alternative embodiment with guide grooves 18 providing alternating perpendicular and parallel orientation guidance for links L of chain 22 while chain 22 is pulled upwardly. The swing arm 12' is pivotably mounted via a pin 24 and mounting support 40 to an offshore structure. The guide ramps 30' and hooks 14' within the interior of swing arm 12' are oriented differently from the embodiment of FIGS. 1–4. As illustrated in FIG. 5, the guide line 26 pulls the chain 22 via the guide device 28 to the mouth 20' of the swing arm 12'. FIG. 6 illustrates a perpendicular link being pulled over ramp 30'. FIG. 7 illustrates a parallel link being pulled through the passage between the plates on which hooks 14' are mounted. While upward tension is maintained on the chain 26, the hooks 14' do not capture one of the links L of chain 22. When tension is released, the swing arm 12' rotates downwardly, and hooks 14' latch one of the links L of chain 26, and the chain 22 is secured to the floating structure via the support 10'.

What is claimed is:

1. An improved chain support (10) for guiding and securing an anchor chain (22) between an offshore structure (100) and an anchor where the chain support (10) includes, a swing arm (12) arranged and designed for mounting to said offshore structure (100) and for pivoting about an horizontal axis (24), the swing arm (12) having a guide mouth (20) and interior passage which is arranged and designed to pass said chain therethrough, a chain guide (16) arranged and designed to orient alternating links of said chain parallel to or perpendicular with respect to a chain longitudinal axis while said chain (22) is being pulled through said guide mouth (20) of said swing arm (12), and a latch mechanism mounted to said swing arm for ratcheting said chain while being pulled therethrough and for latching said chain after a desired tension has been achieved, wherein the improvement is characterized by said latch mechanism including a hook arrangement (14) fixed in said guide mouth (20) and having no parts which move relative to said guide mouth.

2. The improved chain support of claim 1 wherein, said hook arrangement (14) includes first and second plates (50) mounted in said guide mouth (20), each plate (50) having a ramp surface (30) and a hook (14), said first and second plates (50) separated from each other forming a hook passage (36) characterized by a distance large enough to pass a guideline (26) and parallel links which are parallel to the plates (50) between said plates (50), but too small for a perpendicular link which is perpendicular to the plates to pass through, wherein, when said chain (22) is pulled with upward tension through said mouth (20), a perpendicular chain link engages said ramp surfaces (30) causing said swing arm (12) to pivot toward said chain (22) and allowing said chain (22) to ratchet past said hooks (14) of said structures (50), and, when said upward tension is released on said chain (22) a link is latched by said hooks (14) causing said swing arm (12) to pivot downwardly until the tensioned chain is in line with said horizontal axis (24).

3. The improved chain support of claim 2 wherein, each plate extends from said guide mouth toward said interior passage.

4. The improved chain support of claim 2 wherein, each plate extends from said interior passage toward said guide mouth.

5. The improved chain support of claim 4 wherein, said chain guide is integrated in said swing arm such that said chain guide pivots with said swing arm.

6. The improved chain support of claim 2 wherein, said first and second plates are arranged so that when said chain is pulled through said interior passage, said parallel links pass through said hook passage but said perpendicular links pass over said ramp surfaces.

7. The improved chain support of claim 1 wherein, said chain guide (18) is mounted above said swing arm (12) to said offshore structure (100).

8. The improved chain support of claim 1 wherein the improvement further comprises, said chain guide being integrated in said swing arm (12') such that said chain guide pivots with said swing arm.

9. A method of latching an anchor to a chain support, where the chain support includes, a swing are (12) arranged and designed for mounting to an offshore structure (100) and for pivoting about a horizontal axis (24), the swing arm (12) having a guide mouth (20) and interior passage which is arranged and designed to pass said chain therethrough, a chain guide (16) arranged and designed to orient alternating links of said chain parallel to or perpendicular with respect to a chain longitudinal axis while said chain (22) is being pulled through said guide mouth (20) of said swing arm (12), and a latch mechanism mounted to said swing arm includes a hook arrangement fixed in said guide mouth and having no parts which move relative to said guide mouth, the method comprising the steps of, pulling said chain through said guide mouth of said swing arm with tension, and after said chain has been pulled to a desired tension, releasing said tension on said chain until said hook arrangement of said latch mechanism is inserted into a link of said chain, thereby latching said chain to said chain support.

* * * * *

UNITED STATES PATENT AND TRADEMARK OFFICE

CERTIFICATE OF CORRECTION

PATENT NO. : 6,817,595 B1 
DATED : November 16, 2004
INVENTOR(S) : Vernon R. Jenkins and Roy H. Cottrell It is certified that error appears in the above-identified patent and that said Letters Patent is hereby corrected as shown below:

Column 5,
Line 22, delete “are”, insert -- arm --

Signed and Sealed this

First Day of March, 2005

JON W. DUDAS
*Director of the United States Patent and Trademark Office*